United States Patent [19]

Watford

[11] Patent Number: 5,026,057

[45] Date of Patent: Jun. 25, 1991

[54] TOP AND LAUNCHER BOXING SIMULATION GAME AND METHOD

[76] Inventor: Roger L. Watford, 2126 Wilderness Pt., Kingwood, Tex. 77339

[21] Appl. No.: 432,223

[22] Filed: Nov. 6, 1989

Related U.S. Application Data

[63] Continuation-in-part of Ser. No. 209,044, Jun. 20, 1988, and a continuation-in-part of Ser. No. 235,192, Aug. 23, 1988.

[51] Int. Cl.[5] ..... A63F 7/06; A63H 1/02; A63H 1/20

[52] U.S. Cl. ..... 273/85 R; 273/108; 446/256; 446/259

[58] Field of Search ..... 446/256, 259, 257, 258, 446/260–263; 273/85 R, 108, 85 B

[56] References Cited

U.S. PATENT DOCUMENTS

| | | | |
|---|---|---|---|
| 55,766 | 6/1866 | Flagg | 446/263 |
| 175,345 | 3/1876 | Garrett . | |
| 191,756 | 6/1877 | Forbes . | |
| 245,141 | 8/1881 | Dannhorn . | |
| 1,361,637 | 12/1920 | Steen | 446/259 |
| 1,552,530 | 9/1925 | Woods | 273/108 X |
| 2,375,986 | 5/1945 | Gandy | 446/259 |
| 2,818,676 | 1/1958 | Jonker | 446/263 |
| 3,163,426 | 12/1964 | Ruderian | 446/260 |
| 3,224,142 | 12/1965 | Pawelka et al. | 446/259 X |
| 3,430,381 | 3/1969 | Phipps . | |
| 3,879,887 | 4/1975 | Brookson et al. | 446/256 |
| 4,076,252 | 2/1978 | Bernizr et al. | 446/256 X |
| 4,681,320 | 7/1987 | Hildebrant | 446/261 |
| 4,772,241 | 9/1988 | Bro et al. | 446/202 |
| 4,856,790 | 8/1989 | Camillo | 273/428 X |

FOREIGN PATENT DOCUMENTS

| | | | |
|---|---|---|---|
| 333546 | 11/1903 | France | 446/259 |
| 136741 | 12/1919 | United Kingdom | 446/259 |

OTHER PUBLICATIONS

"Jet Spinner"-3/10/66—Advertisement Brochure.

*Primary Examiner*—Mickey Yu

[57] ABSTRACT

Toy tops are provided having the appearance of human boxers and simulated boxing gloves. A motorized launch is used for spinning the tops and causing the boxing gloves of one top to strike another top. A simulated boxing ring is used to conduct a simulated boxing match with the tops.

18 Claims, 1 Drawing Sheet

TOP AND LAUNCHER BOXING SIMULATION GAME AND METHOD

This is a continuation-in-part of application Ser. No. 07/209,044 filed on June 20, 1988, and a continuation-in-part of application Ser. No. 07/235,192 filed on Aug. 23, 1988.

FIELD OF THE INVENTION

This invention relates to gyroscopic tops and, in particular, to a toy top having the simulated appearance and attributes of a boxer, hence the name Boxing Top TM. In addition, the invention provides a motorized launch for aiming and launching the top so that it will reliably land and spin in a desired area. Finally, the invention provides a boxing ring having a contoured floor such that a simulated boxing match with the Boxing Top TM may be conducted.

BACKGROUND OF INVENTION

A top is a commonly cylindrical or conoidal child's toy that has a tapering point on which it is made to spin. The gyroscopic nature of the spinning top gives it unusual stability, and it offers considerable opposition to any torque that would change the direction of the axis of spin. This has long provided a fascination to children, and indeed games with tops have been in use for many years. Such games, while requiring skill, have generally been of rather simple nature. Today, in an era of sophisticated, mechanical and computerized games, tops no longer hold the fascination of years past. Obviously, bringing this toy back to it's former prominence would require not only a more interesting appearance designed to hold the attention and spark the imagination, but also an appealing, sophisticated, life-like game with which to play such a toy. Accordingly, the present invention is directed to providing a redesigned top and method for the use there of, in order to fulfill this need in the toy art.

SUMMARY OF INVENTION

The primary purpose of the present invention is to provide a redesigned top, apparatus for spinning the top, and a method for simulating a boxing match with the redesigned top which are more entertaining and require greater skills than other contemporary tops and similar toys.

Accordingly, the present invention involves tops having the appearance and attributes of boxers, i.e. pugilists. A method and means for practicing the method are provided for simulating a boxing match with the Boxing Tops TM which comprises spinning the tops in a simulated boxing ring and allowing the tops to make contact through boxing gloves protruding from the tops. Preferably, the tops are allowed to spin in the boxing ring for a preselected length of time covering a round of boxing, and each top is scored for the round based on whether it knocks down an opposing top. Even more preferably, the game covers a series of rounds comprising a match or bout, and the scores of each round for each top are summed, and a winning top is designated based on the highest score.

The Boxing Tops TM of the present invention comprise a body portion, and a set of boxing gloves attachable to the body portion. Preferably, the boxing gloves are selected from sets of boxing gloves of varying sizes, which provides a certain reach (i.e. arm-span) for the top. Also, the tops preferably are in varying weights. Both features, reach and weight, are prominent in actual boxing and enhance the real-life attributes of the present game. In the course of playing a game with the tops, the selections of top based on weight and boxing gloves based on reach, may be governed by rules involving chance and/or skill.

A boxing ring preferably is provided for use with the Boxing Tops TM, the ring comprising an area enclosed on four sides and having a concave floor sloping downwardly toward a center point of the boxing ring.

Another highly preferred feature of the present invention is an apparatus for spinning and launching the Boxing Tops TM into the ring. This apparatus comprises a base adapted to support the top in an upright position, a rotatable chuck functionable to releasably engage the head portion of the top and impart a spinning motion to the top, a motor for rotating the chuck which is located above the chuck and movable within a housing, means for moving the chuck and motor within the housing to engage the top of the chuck, and a trigger for controlling operation of the motor which is positioned on a handle connecting the base to the housing. Preferably, the means for moving the motor and chuck is a spring mounted lever operative to press the chuck against the head portion of the top in order to assume a position for spinning the top.

DESCRIPTION OF PREFERRED EMBODIMENTS

Figure 1:
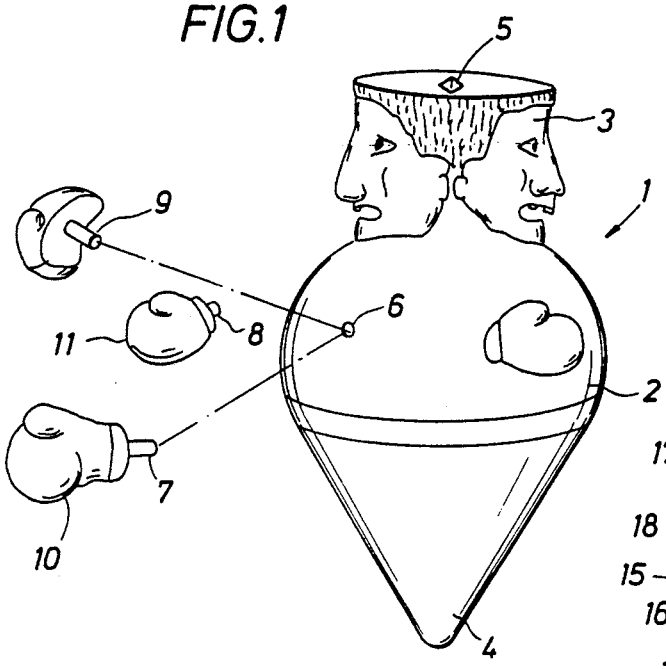
FIG. 1 shows the Boxing Top TM of the present invention with a selection of different sized gloves which provide the top with a varying reach, depending upon glove choice.

Reference may be had to FIG. 1 of the drawings which discloses a top 1 having a body portion 2, a head portion 3, and a tapering portion 4 on which the top is made to spin.

Head portion 3 is designed in the configuration of a real-life boxer.

Preferably, two faces are utilized, each on opposite sides of the head portion. However, either a single face with a rear-of-the-head side or several faces may be utilized. What is preferred is that the top have many of the physical attributes of a real boxer. At the top of the head portion is an orifice 5 for received a chuck, described hereinafter. Alternatively, the male-female relationship of orifice 5 and the chuck could be reversed with a male member being provided instead of orifice 5 and a corresponding female member where the chuck would customarily be located. Alternatively, other well known attachment means could be utilized. While the top of head portion 3 is shown to be relatively flat, this is not essential inasmuch as other shapes, e.g. rounded, may be utilized.

Body portion 2 is provided with orifices 6 to receive rod 7, 8 or 9 attached to corresponding boxing glove 10, 11 or 12 respectively. As above mentioned with respect to orifice 5 and the chuck, the male-female location of parts, may be reversed so that the orifice is in the glove and the rods are on body portion 2, or other attachment means, e.g. Velcro TM, may be employed. Gloves 10, 11 and 12 are shown in different configurations and in different sizes. This is primarily to provide a different "reach", i.e. different arm-span, which is selectable for the top to be used. Again, this is another life-like feature of the invention which is of significance to real-life boxers. Preferably, each top is provided with four gloves of the same size. It is manifest that a different number of gloves could be employed. It is not desired that the gloves ordinarily be of different sizes since this may adversely affect the balance of the top.

Figure 2:
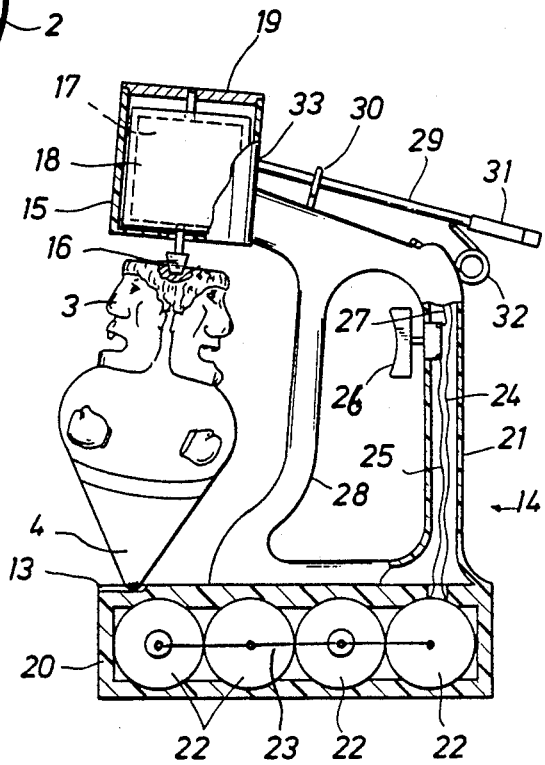
FIG. 2 is a view with partial cutaway sections and shows the Boxing Top TM of FIG. 1 positioned in an apparatus for spinning and launching the top into a boxing ring.

Referring now to FIG. 2, it may be seen that the point of tapering portion 4 of top 1 fits into a corresponding groove 13 of base 20 of launch mechanism 14. The head portion 3 resides under a housing 15 or the launch mechanism 14, and orifice 5 engages with chuck 16. A cutaway of housing 15 exposes a view of motor 17 attached to rotate chuck 16 and enclosed within cannister 18. A lid 19 encloses motor 17 within cannister 18. Lid 19 preferably has a friction fit with the cannister although a screw-on or other fit would be suitable.

Base 20 is attached to housing 15 by a handle 21. Cutaways of base 20 and handle 21 are provided which show, respectively, batteries 22 connected by wire 23 and wires 24 and 25 in handle 21. Wire 25 connects to trigger 26 and wire 27 passes therefrom to motor 17. Trigger 26 is contoured for finger fit and operates by moving in and out to connect and disconnect wires 25 and 27 in a manner well known to the art. Four "C" batteries have been found to provide ample power for the motor in a prototype unit. Of course, it is not necessary to use an electric motor inasmuch as a spring-wound motor could be employed. If the latter were used, trigger 26 would not act to interrupt electric current in wires 25 and 27, but would instead function as a mechanical switch to start and stop the spring-wound motor (not shown). Handle 21 is completed by a reinforcement member 28 which provides structural strength to the apparatus and protects the hand of an operator of the apparatus from spinning top 1.

Spring-mounted lever 29 functions to move cannister 18 up and down within housing 15, thereby also moving motor 17, contained within the cannister, and chuck 16 attached to the motor. Movement of the chuck is operative to engage and disengage it with the orifice 5, thereby assuming a position to spin the top. Lever 29 passes through and pivots about a supporting eye-screw 30 and terminates at one end in a contoured thumb-fit support 31. The latter is biased upwardly by pressure from spring 32 which presses against handle 21. The opposite end of lever 29 passes through a slot 33 in housing 15 and connects to cannister 18 via orifice 34 (shown in FIG. 3). The connection between cannister 18 and lever 29 in preferably a loose fit to permit pivoting movement therebetween.

Figure 3:
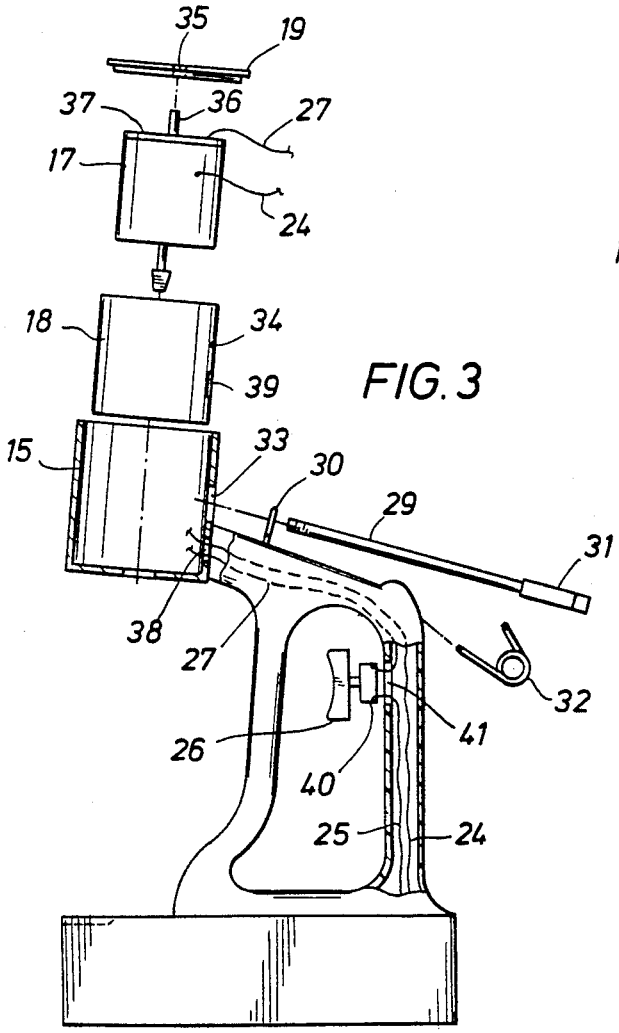
FIG. 3 provides an exploded view with partial cutaway sections of the spinning and launch apparatus of FIG. 2.

Now referring to FIG. 3, an exploded view of the apparatus shown in FIG. 2 may be seen. Lid 19 fits over motor 17 and onto cannister 18 and has an orifice 35 of larger diameter than axle 36 of motor 17 to permit free movement of the axle. Top 37 of motor 17 connects to negative wire 27 and positive wire 24 connects to the motor. Some slack is provided in these wires after they pass through orifice 38 of housing 15 and orifice 39 of cannister 18 to permit unrestricted up and down movement of the cannister.

An exploded view is also provided of lever 29 to facilitate showing how it passes through eye-screw 30, slot 33 into cannister 18 via orifice 34. Spring 32 is shown in an untensioned state. Normally spring 32 remains in a tensioned position as shown in FIG. 2 by putting upward pressure on support 31. Trigger 26 also appears in an exploded view and shows its attachment to base member 40 having poles which are attachable to wires 25 and 27 and which fits into orifice 41 of handle 21.

Figure 4:
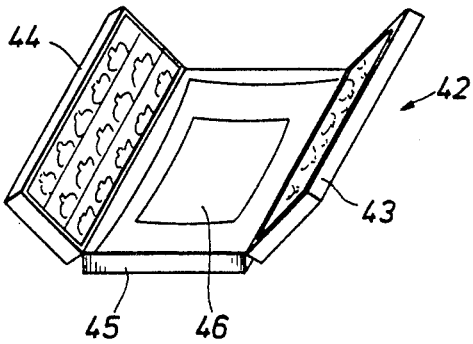
FIG. 4 shows a boxing ring arranged with storage for the tops and launch apparatus in a carrying case.

Reference may now be had to FIG. 4 which shows a carrying case 42 which contains tops within folding sides 43 and 44 along with one or more top spinning devices as above described. The third side 45 of the carrying case 42 simulates a boxing ring defined by an area enclosed on four sides and having a concave floor 46 sloping downwardly toward a center point of the boxing ring. The slope is slight (e.g. 5°) but ensures that the Boxing Top TM will eventually move to the center of the ring before a round ends and engage each other.

Simulation of a boxing match with the Boxing Tops TM preferably is conducted by the following procedure. Players select a Boxing Top TM, preferably according to weight (which preferably is shown on the top), the heaviest top being the more desirable as in real-life boxing. Order of selection is determined preferably in advance, either by chance (e.g. throw of the dice) or skill (e.g. pitching tokens on a target). After tops are selected by the players, then boxing gloves preferable are selected. The boxing gloves are of varying size, as described supra, some providing a greater reach than others, thereby providing some advantage, as in real-life boxing. Again, selection may be governed by chance or skill as described supra. Manifestly, either or both of these two described selection steps may be dispensed with and the game still be within the scope of the present invention, i.e. all the tops may have the same weight and non-exchangeable boxing gloves, or the tops may have different weights and non-exchangeable boxing gloves, or the tops may have the same weight and exchangeable boxing gloves.

Launching of the tops into the boxing ring may be conducted sequentially or simultaneously. If sequential, the order of launching may be in accordance with the disadvantaged boxer preferably launching last, or the order may be determined by luck or skill as described supra.

After the tops are launched into the ring, they will tend to move toward the center, due to the slight slope of the ring floor. Preferably a round of boxing will be limited to a preselected time, e.g. one minute, and timing may be accomplished with devices known to the art and supplied with the game (e.g. a sand glass). Scoring of the tops (e.g. with a score card) for each round preferably is based upon which top secures a knockdown of the other top. If no knockdown occurs or if reasonably simultaneous knockdowns occur, then the round is preferably pronounced a draw, with no score being awarded. In a most preferred embodiment, the tops engage in a predetermined number of round, scores are summed for the rounds, (e.g. with a score card) and a winning top is designated.

The above description is for the purpose of teaching the person of ordinary skill in the art how to practice the present invention, and it is not intended to detail all of those obvious modification and variations of it which will become apparent to the skilled artist and upon reading the description. It is intended, however, that all such obvious modifications and variations be included within the scope of the present invention which is defined by the following claims.

I claim:

1. A method for simulating a boxing match with tops comprising:

A. providing at least two tops, each top comprising a body portion, a head portion, and a tapering portion functional for spinning the tops, said head portion having the configuration of a real-life boxer, and said body portion having protruding simulated boxing gloves;

B. spinning said at least two tops in a simulated boxing ring; and

C. allowing the tops to spin and make contact by means of the simulated boxing gloves protruding from the tops.

2. The method of claim 1 including designating a winning top as the last top to continue spinning in the boxing ring.

3. The method of claim 2 including allowing the tops to spin in the boxing ring for no more than preselected length of time covering a round of boxing and scoring each top for its performance during the round.

4. The method of claim 3 including spinning the tops for a preselected number of rounds covering a match and summing the scores of each round for each top and designating a winning top.

5. The method of claim 1 including selecting the boxing gloves to be placed on each top, the boxing gloves being in sets of varying size, such that each set of boxing gloves will provide a top with a certain reach.

6. The method of claim 5 wherein said selecting is determined by a method involving at least one criterion among chance and skill criteria.

7. The method of claim 1 wherein said tops are selected for said boxing match based on the criterion of the weight of each top.

8. The method of claim 7 wherein the choice of a top based on weight is determined by a method involving at least one criterion among chance and skill criteria.

9. A method for simulating a boxing match with tops comprising:

A. providing at least two tops and a simulated boxing ring;

B. providing boxing gloves in sets of varying size, such that each set of boxing gloves will provide a top with a certain reach, and selecting the boxing gloves to be placed on each top from among the sets of boxing gloves; and C. spinning the tops in the boxing ring, and allowing the tops to make contact by means of the simulated boxing gloves protruding from the tops.

10. The method of claim 9 wherein the choice of boxing gloves to be placed on a top is determined by a method involving at least one criterion among chance and skill criteria.

11. An apparatus for spinning a top comprising:

A. a base adapted to support the top in an upright position;

B. a rotatable chuck functionable to releasably engage the head portion of the top and impart a spinning motion to the top;

C. a motor for rotating the chuck, said motor being located above the chuck and movable within a housing;

D. means for moving the chuck and motor within the housing to engage the top with the chuck; and E. a trigger for controlling operation of the motor, said trigger being held by a handle connecting the base to the housing.

12. The apparatus of claim 11 wherein said means for moving the motor and chuck is a spring-mounted lever operative to press the chuck against the head portion of the top in order to assume a position for spinning the top.

13. The apparatus of claim 11 wherein the motor is electric and is connected by power supply lines passing through the handle via said trigger to battery means in the base.

14. The apparatus of claim 11 wherein the top is supportable in a groove which is operative to slidably release the top from the base after the chuck is disengaged from the head portion of the top.

15. A game set comprising:

A. a toy top having a body portion and means to attach selected simulated boxing gloves to the body portion; and B. an assortment of simulated boxing gloves of varying sizes from which said selected simulated boxing gloves are selectable.

16. The game set of claim 15 further including a motorized launch mechanism.

17. The game set of claim 15 further including a boxing ring comprising an area enclosed on four sides and having a concave floor sloping downward toward a center point of the boxing ring.

18. The game set of claim 15 wherein said simulated boxing gloves are configured to provide a certain reach for the toy top, said reach being dependent upon the selection of boxing gloves from said assortment of boxing gloves.

* * * * *